US005354378A

United States Patent [19]

Hauser et al.

[11] Patent Number: 5,354,378

[45] Date of Patent: Oct. 11, 1994

[54] SLOT NOZZLE APPARATUS FOR APPLYING COATINGS TO BOTTLES

[75] Inventors: Larry Hauser, Suwanee, Ga.; Jurgen Benecke, Brandenburger, Fed. Rep. of Germany; Arthur Cieplik, Luneburg, Fed. Rep. of Germany; Thomas Burmester, Bleckede, Fed. Rep. of Germany; Michael L. Gill, Westlake, Ohio; Kerry Washington, Stone Mountain, Ga.; Ron Evans, Neutral Bay, Australia

[73] Assignee: Nordson Corporation, Westlake, Ohio

[21] Appl. No.: 910,686

[22] Filed: Jul. 8, 1992

[51] Int. Cl.[5] ..... B05B 12/02; B05B 13/02

[52] U.S. Cl. ..... 118/696; 118/58; 118/320; 118/DIG. 2; 215/12.2; 239/299; 239/562; 239/565; 239/568; 239/597

[58] Field of Search ..... 118/707, 58, 300, 320, 118/DIG. 2, 696; 427/421, 425, 195; 215/233, 261, 12.2, DIG. 2, DIG. 6; 425/90, 97, 464; 239/299, 562, 565, 568, 601

[56] References Cited

U.S. PATENT DOCUMENTS

| | | | |
|---|---|---|---|
| Re. 30,805 | 11/1981 | Rhoads | 215/DIG. 6 |
| Re. 33,481 | 12/1990 | Ziecker et al. | 239/298 |
| 999,789 | 8/1911 | Hussey | 118/320 |
| 1,024,917 | 4/1912 | Trexler | 215/233 |
| 2,249,205 | 7/1941 | Hansen | 118/320 |
| 2,683,627 | 7/1954 | Wahlin | 239/597 |
| 3,199,789 | 8/1965 | James | 239/568 |
| 3,559,834 | 2/1971 | Taylor | 215/261 |
| 3,595,204 | 7/1971 | McIntryre | 118/8 |
| 3,802,908 | 4/1974 | Emmons | 118/320 |
| 3,806,289 | 4/1974 | Schwarz | 425/72 R |
| 3,825,379 | 7/1974 | Lohkamp et al. | 425/72 R |
| 3,843,055 | 10/1974 | Nord et al. | 239/599 |
| 3,911,161 | 10/1975 | Nord et al. | 427/195 |
| 3,953,626 | 4/1976 | Suzuki et al. | 427/346 |
| 3,972,759 | 8/1976 | Buntin | 156/167 |
| 3,999,509 | 12/1976 | Lucas | 118/406 |
| 4,011,122 | 3/1977 | Ashcroft | 215/12.2 |
| 4,047,861 | 9/1977 | Balaz | 425/6 |
| 4,059,714 | 11/1977 | Scholl et al. | 428/310 |
| 4,129,225 | 12/1978 | Bailey | 215/12.2 |
| 4,133,970 | 1/1979 | Lusk | 264/12 |
| 4,156,398 | 5/1979 | McDaniel | 118/2 |
| 4,171,056 | 10/1979 | Hannon et al. | 215/12.2 |
| 4,247,581 | 1/1981 | Cobbs, Jr. et al. | 427/421 |
| 4,394,915 | 7/1983 | Nelson | 215/12.2 |
| 4,476,165 | 10/1984 | McIntyre | 427/258 |

(List continued on next page.)

FOREIGN PATENT DOCUMENTS

| | | | |
|---|---|---|---|
| 2824403 | 12/1979 | Fed. Rep. of Germany | 215/233 |
| 3500269 | 7/1986 | Fed. Rep. of Germany | 215/233 |
| 89110046.3 | of 1989 | Fed. Rep. of Germany . | |

(List continued on next page.)

*Primary Examiner*—Joseph W. Drodge
*Attorney, Agent, or Firm*—Wood, Herron & Evans

[57] ABSTRACT

Apparatus and methods for producing coatings, such as wax or hot melt adhesive, onto the tops and necks of wine bottles or similar objects. A slot nozzle die has elongated air slots along a vertically oriented slot extrusion opening. A hot melt or wax gun is disposed above the bottle neck to apply a bead of adhesive to the bottle top. In the operation of the apparatus, the air flow is initiated from both air slots prior to the initiation of the hot melt flow and is continued beyond that point in time, when the hot melt flow ceases. The air carries a film of coating material horizontally to the bottle neck. Means are provided for spinning the bottle about its vertical axis. The delays between the operations of the air flow and the coating flow are on the order of micro seconds. The merged coatings are heated to smooth the coating finish to produce a traditional neck seal.

28 Claims, 5 Drawing Sheets

U.S. PATENT DOCUMENTS

| | | | |
|---|---|---|---|
| 4,553,701 | 11/1985 | Rehman et al. | 239/298 |
| 4,687,137 | 8/1987 | Boger et al. | 118/325 |
| 4,714,647 | 12/1987 | Shipp, Jr. et al. | 428/212 |
| 4,720,252 | 1/1988 | Appel et al. | 425/72 R |
| 4,735,169 | 4/1988 | Cawston et al. | 118/411 |
| 4,746,545 | 5/1988 | McIntyre | 427/176 |
| 4,753,819 | 6/1988 | Shimada | 427/96 |
| 4,774,109 | 9/1988 | Hadzimihalis et al. | 427/286 |
| 4,778,631 | 10/1988 | Cobbs, Jr. et al. | 261/128 |
| 4,815,660 | 3/1989 | Boger | 239/8 |
| 4,818,464 | 4/1989 | Lau | 264/510 |
| 4,836,440 | 6/1989 | French | 229/132 |
| 4,850,514 | 7/1989 | Scholl et al. | 222/146.5 |
| 4,874,451 | 10/1989 | Boger et al. | 156/291 |
| 4,880,663 | 11/1989 | Shimada | 427/96 |
| 4,891,249 | 1/1990 | McIntyre | 427/421 |
| 4,906,492 | 3/1990 | Groshens | 427/148 |
| 4,957,783 | 9/1990 | Gabryszewski | 427/424 |
| 4,983,109 | 1/1991 | Miller et al. | 425/7 |
| 4,983,424 | 1/1991 | Saidman et al. | 427/421 |
| 5,000,112 | 3/1991 | Rothen et al. | 118/411 |
| 5,016,812 | 5/1991 | Pedigrew | 229/132 |
| 5,145,689 | 9/1992 | Allen et al. | 425/72.2 |
| 5,209,410 | 5/1993 | Wichmann et al. | 239/568 |
| 5,236,641 | 8/1993 | Allen et al. | 264/40.1 |
| 5,269,670 | 12/1993 | Allen et al. | 425/72.2 |

FOREIGN PATENT DOCUMENTS

| | | | |
|---|---|---|---|
| 329813 | 8/1989 | Fed. Rep. of Germany . | |
| 0359943 | 3/1990 | Fed. Rep. of Germany . | |
| 2163733A | 3/1986 | United Kingdom | 215/233 |

SLOT NOZZLE APPARATUS FOR APPLYING COATINGS TO BOTTLES

This case is generally related to the following United States Patent Applications filed on even data herewith:

| Title | Inventors |
|---|---|
| Apparatus & Methods for Applying Discrete Coating Ser. No. 07/910,781 | J. Benecke; A. Cieplik; T. Burmester |
| Segmented Slot Die for Air Spray of Fibers Ser. No. 07/910,784 | M. Gill; J. Benecke; A. Cieplik; T. Burmester |
| Apparatus & Methods for Applying Discrete Foam Coatings Ser. No. 07/910,768 | J. Raterman; J. Benecke; A. Cieplik; T. Burmester M. Gill |
| Apparatus & Methods for Applying Conformal Coatings to Electronic Circuit Boards Ser. No. 07/910,686 | B. Boger; J. Benecke; A. Cieplik; T. Burmester; M. Gill |
| Apparatus & Methods for Intermittently Applying Discrete Adhesive Coatings Ser. No. 07/911,674 | J. Raterman; J. Benecke; A. Cieplik; T. Burmester; M. Gill |

The disclosures of these five applications are expressly incorporated herein by reference in their entirety.

This invention relates to the application of coatings to wine bottles and more particularly to apparatus and methods for applying non-lead coatings to the necks of wine and liquor bottles.

In the bottling of wine or liquor, it is common to apply metal or foil seals to the tops and necks of the bottles over the ubiquitous corks. More recently, it has become common to apply a synthetic plastic, capsule-like seal over the top and neck of such bottles. Both such coatings have several inherent disadvantages.

In the case of the metal-like seal, the seal material typically contains lead which is now undesirable for use in consumer products or packaging. In the case of plastic, shrink-on plastic seals are used. These typically give off undesirable vapors or fumes when shrunk onto the bottle necks. Moreover, certain prior processes for applying bottle neck included the necessity of purchasing expensive pre-stamped neck capsules.

Accordingly, it is desirable to provide a bottle neck seal which eliminates use of lead-containing materials, which does not give off undesirable fumes when applied, and which does not require pre-stamped neck capsules.

Accordingly, it has been one objective of this invention to provide improved methods and apparatus for applying sealing coatings to the necks of wine and liquor bottles.

A further objective of the invention has been to eliminate lead and plastic containing materials in the application of neck seals to wine and liquor bottles while still providing an acceptable, attractive seal.

To these ends, a preferred embodiment of the invention contemplates the application of an integral bottle neck coating, comprising wax, applied to a spinning bottle top and adjoining neck by a bead applying gun and a wax spray slot die. The wax applied at the top and on the neck coalesces to form an integral seal. Heat is then preferably applied to smooth the top and neck wax into an acceptable appearance. The non-contact application process accommodates non-uniform, non--symmetrical bottle tops and necks.

While wax is preferable as a coating material, the invention also contemplates the use of hot melt adhesive or other suitable materials as a coating material. Neither wax nor hot melt adhesive contain lead nor give off undesirable fumes as do prior coatings.

The application of wax or hot melt to the spinning bottle neck is accomplished by means of a vertically elongated continuous slot die for extruding wax or hot melt adhesive moving horizontally to the bottle in a vertical plane. The coating material is carried horizontally in a vertical plane to the spinning bottle neck by a flow of air impinging on the extruded wax or hot melt to spray it onto the bottle neck.

These and other objectives and advantages will become readily apparent from the following detailed description of a preferred embodiment of the invention and from the drawings in which.

Figure 3:
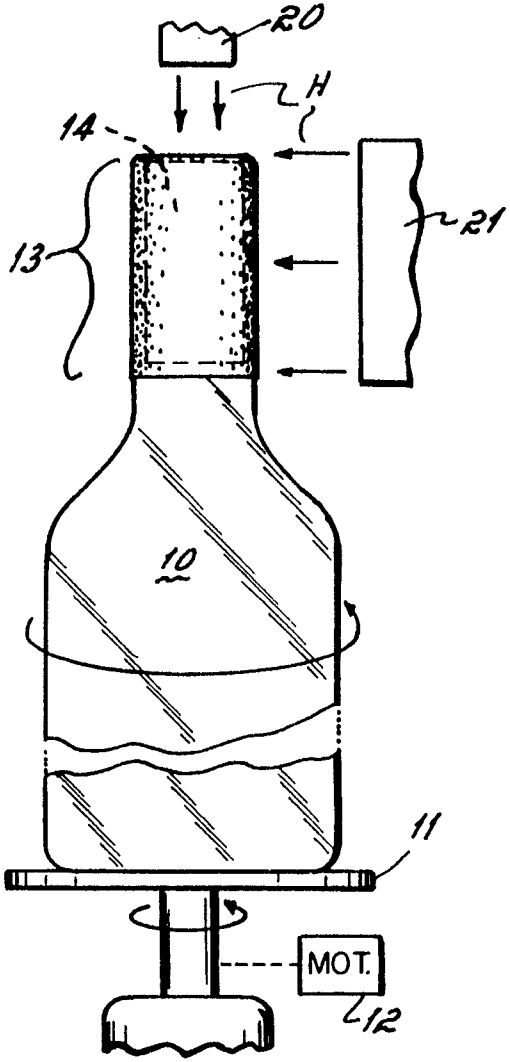
FIG. 3 is an elevational view illustrating diagrammatically control and final heating step in the application of a coating to the top and neck of a bottle according to the invention.
Figure 2:
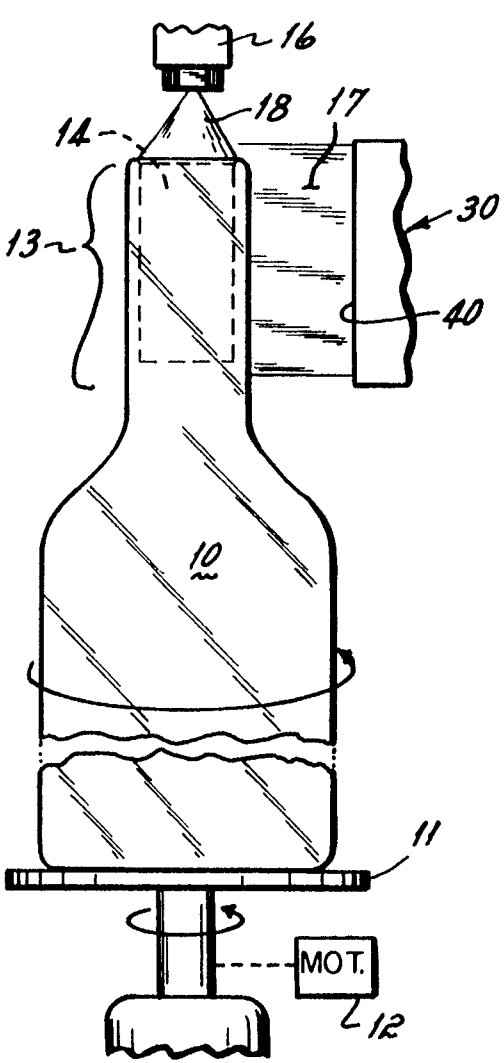
FIG. 2 is an elevational view illustrating a second step in the application of a coating to the top and neck of a bottle according to the invention.
Figure 1:
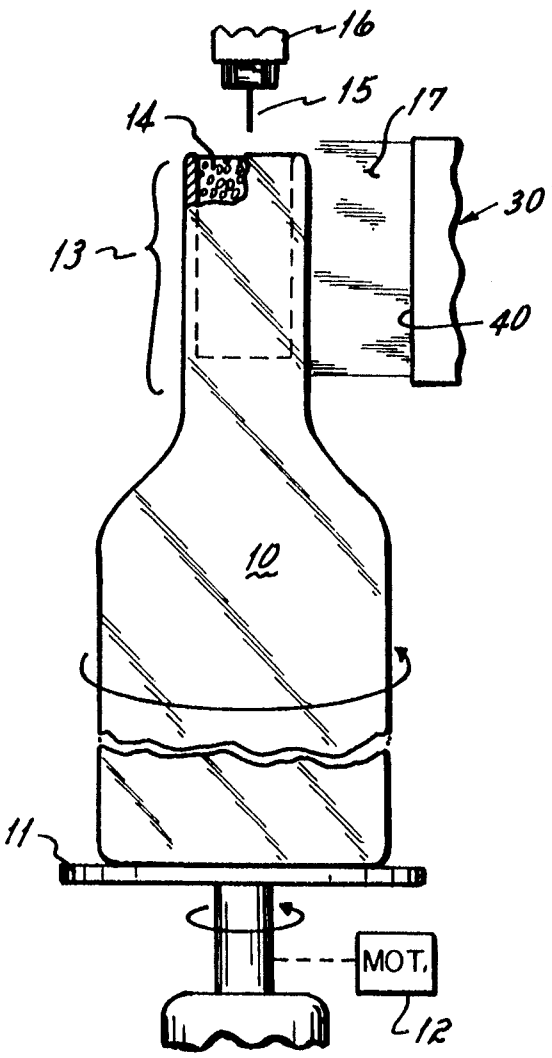
FIG. 1 is a diagrammatic view illustrating the first step in the application of coating to the top and neck of a bottle according to the invention.

Turning now to the drawings, the coating of a wine bottle 10 is illustrated in FIGS. 1–3. In each figure, it will be appreciated that the wine bottle is supported on a table 11, rotated by a motor 12 in the direction of the arrows as shown, for spinning the bottle. The bottle 10 has a neck 13 and a top defined by the cork 14. Referring to FIG. 1, as the bottle spins, a bead 15 of hot melt adhesive or wax is applied by a gun 16 to the center area of the cork 14. In addition, a wax film 17, for example, disposed in a vertical plane, as shown, is applied by slot nozzle die means 30 thereto.

Moving to FIG. 2, gun 16 is now controlled to apply a spiral 18 of coating material to the top of the cork 14. At the same time, the slot nozzle die means 30 still operates to continue the application of a film of coating material to the neck 13 of the bottle.

Turning now to FIG. 3, it will be appreciated that the bottle is still spun by means of the table 11 and motor 12. At this point, however, a heat gun 20 and a heat gun 21 are utilized to apply finish heat to the coating material applied by the top 14 and the neck 13 of the bottle, the application of heat H being illustrated diagrammatically in FIG. 3. The heat is applied to smooth out the coating when the coating is of a waxy or thermoplastic material, so as to eliminate pin holes or roughness in the coating, and to provide a smooth coating finish.

It will be appreciated that at this point in FIG. 3, the gun 16, as shown in FIGS. 1 and 2, has been retracted to make room for the heat gun 20, while the slot nozzle die means 30, as shown in FIGS. 1 and 2, has been retracted or removed to make room for the heat applicator 21. Alternatively, the heat applicator 21 can simply be mounted at a different angular position around the neck of a spinning bottle, so that the slot nozzle die means 30 does not have to be moved.

At the same time, it will be appreciated that both the coating applying gun 16 and slot nozzle die means 30 can be provided with means for applying heat, as illustrated in FIG. 3, such as by means of the application of heated air to the coating, as applied to the bottle top and neck as shown in FIG. 3, so that additional heat guns or apparatus are not required.

Returning now to FIGS. 1 and 2, the gun 16 may be any suitable gun for applying a bead 15, as shown, to the center of the cork 14, and for swirling the bead in a pattern shown at 18, to apply coating or bead to the outer edges of the cork 14 of the bottle. This outer edge coating engages and coalesces with the coating material applied by the slot nozzle die means 30 to form an integral coating or seal.

Any suitable gun 16 for applying coating material to the top of the bottle can be utilized. However, one particular gun which has been found suitable is an applicator or gun manufactured by Nordson Corporation of Westlake, Ohio, and produced under its controlled fiberization gun model CF201-HAM gun. It will also be appreciated that the gun 16 can be such a gun as shown in U.S. Pat. No. Re. 33,481, specifically incorporated herein by reference. Any other suitable gun or applicator for applying the wax or hot melt adhesive coating can be utilized.

Moreover, it will be appreciated that the coatings applied to the bottle necks as illustrated herein, are preferably either wax or hot melt adhesives, both of which can be applied in the apparatus as described herein, but could be other suitable coatings.

It will be appreciated that due to the fact that many bottles are non-uniform or non-symmetrical, it is important to be able to apply a web of material to the bottle neck by means of a non-contact process, where the applicator itself does not contact the spinning bottle neck. It will be recognized in this application that a web is extruded from and held in a generally vertical plane, until it is sprayed horizontally onto the neck of the bottle. Apparatus for accomplishing this will now be described.

Figure 4:
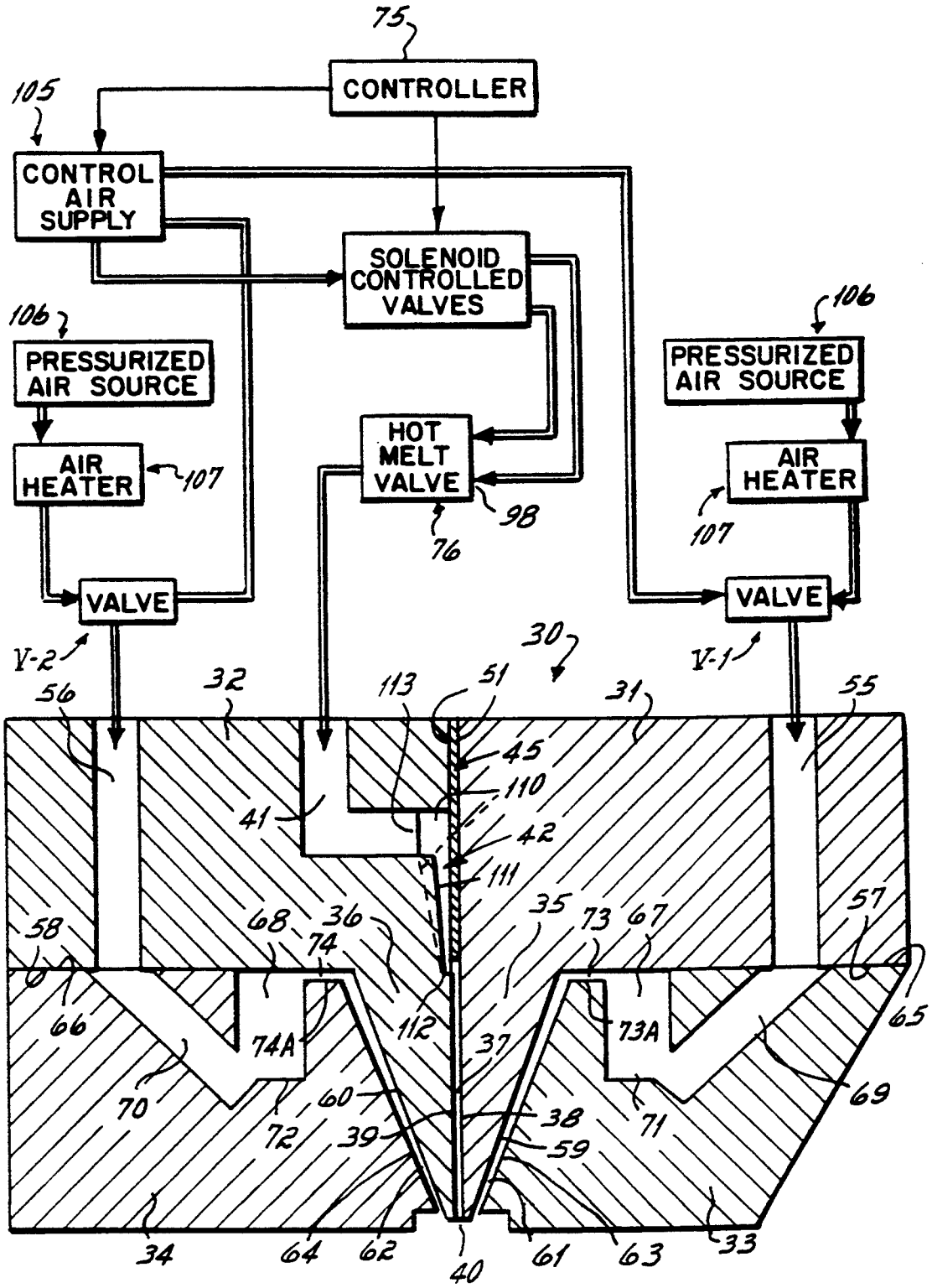
FIG. 4 is a diagrammatic side view in partial cross section of slot die apparatus for applying the neck coating illustrated in FIGS. 1–3.

There will now be described the apparatus for generating discrete, uniform bottle neck coatings of wax or hot melt adhesive having sharp, square cut-on and cut-off edges. FIG. 4 illustrates various features of a die means 30 and air and wax or hot melt adhesive controls according to the invention. Wax or hot melt adhesive can be used as the coating.

It will be appreciated that FIGS. 4–8 show the details of slot nozzle die 30 in a vertical orientation, and the details are so described, but that the slot nozzle die 30 will be oriented 90 degrees from that shown in these figures to that shown in FIGS. 1–3 to produce the coating film as shown in FIGS. 1–3. The die means 30 comprises two die halves 31, 32, and two air blocks 33, 34. Each die block 31, 32 includes a downwardly depending projection 35, 36. The die halves 31, 32 define between them an extrusion slot 37. Slot 37 is defined by the face 38 of the die half 31 and the face 39 of the die half 32. Face 38 is juxtaposed with respect to the face 39, as shown. The extrusion slot 37 terminates at an elongated slot or extrusion outlet 40.

As noted in the Figures, the air blocks extend below the outlet 40 to provide a degree of protection from mechanical damage.

Figure 7:
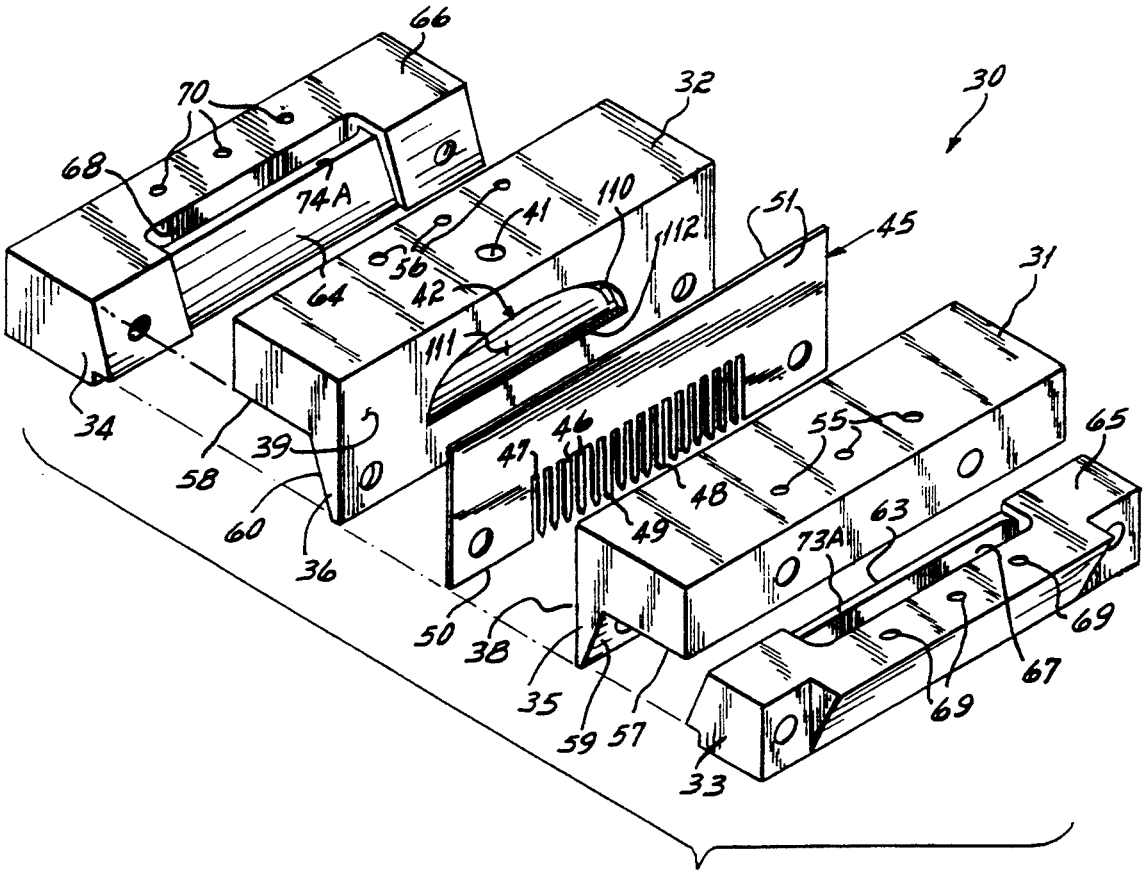
FIG. 7 is an exploded view of the slot nozzle die of FIG. 4.
Figure 8:
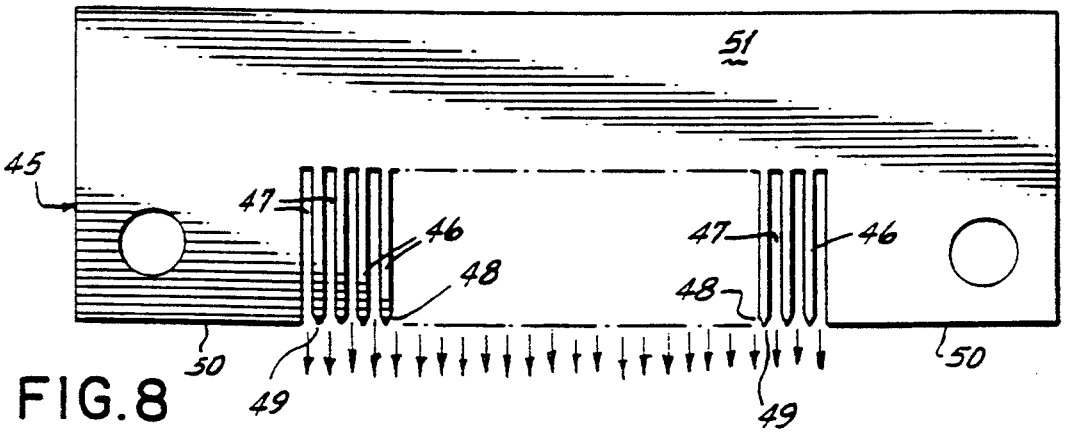
FIG. 8 is a front view of the slotted shim used in the slot nozzle of FIG. 7.

Die half 32 includes a wax or hot melt passageway 41 for receiving the coating material and conducting it to a "coat hanger" portion 42 of the die half 32, details of which are perhaps better seen in FIG. 7. A slotted or segmented shim 45, as best seen in FIG. 8, and a portion of which is seen in FIG. 4, is located between the juxtaposed surfaces 38 and 39 of the die halves 31 and 32. The shim 45 has a plurality of elongated projections 46, defining between them a plurality of elongated channels or slots 47.

Figure 8A:
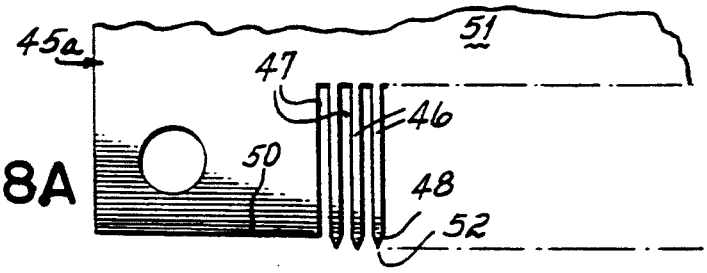
FIG. 8A is a partial view of an alternative shim.

Each of the projections has a downstream tapered end portion 48, having a preferably sharp tip 49 which is preferably flush with the lower edge 50 of the shim, and preferably flush with the elongated slot nozzle extrusion outlet 40 (FIG. 4), although it could terminate short of or extend outwardly thereof. In FIG. 1, only the top portion 51 of the shim 45 is shown, for the purpose of clarity. Alternately, an open shim can be used. Also, an alternative shim 45*a* is shown in FIG. 8A. That shim has pointed projections 52 which extend beyond slot outlet 40, preferably two or three thousandths of an inch.

Returning now to FIG. 4, each of the upper die halves 31, 32 is provided with an air passageway 55, 56, extending from an upper surface of the die to a lower respective surface 57, 58. Each die half 31, 32 also includes an inclined surface 59, 60, depending from the surfaces 57 and 58, respectively. The inclined surfaces 59 and 60 define one part of an air passage, or air slot 61 and 62, as will be described.

Turning now to the air blocks 33 and 34, it will be appreciated that each of them include an inclined surface 63 and 64, respectively, which define the other side of the air slots 61 and 62 with the juxtaposed respective surfaces 59, 60, all as shown in FIG. 4. Each of the air blocks 33 and 34 include an upper surface 65, 66 juxtaposed to the respective lower surfaces 57 and 58 of the die halves 31, 32.

Figure 5:
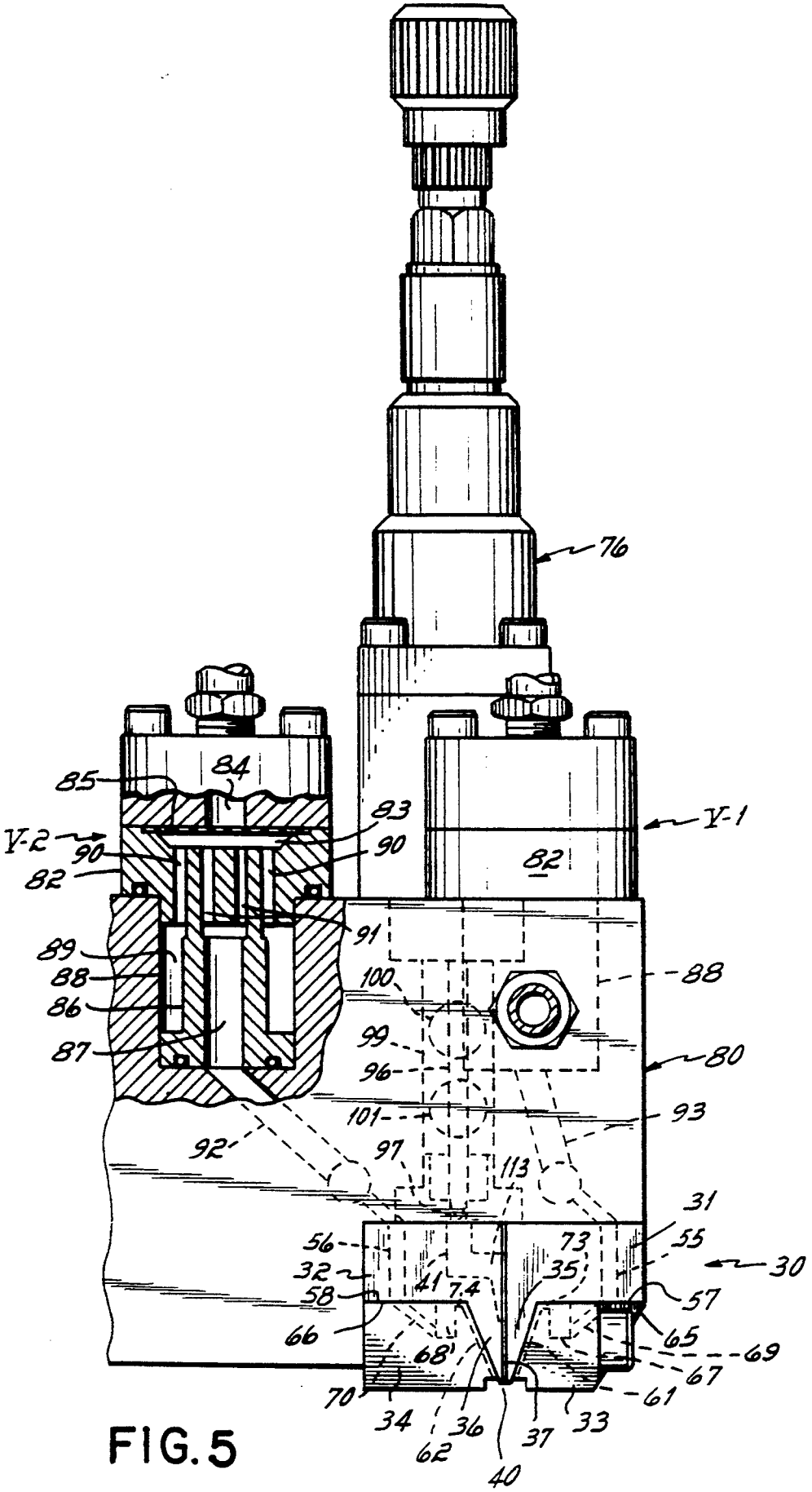
FIG. 5 is an elevational side view impartial cross section of a slot nozzle coater used in applying coatings according to the invention.

An elongated air plenum 67, 68 is formed in each of the air blocks 33, 34. The plenums 67, 68 are also seen in FIG. 5. Respective air passages 69 and 70 are formed in the respective air blocks 33 and 34 and extend from the respective surfaces 65 and 66 to a lower portion 71, 72 of the respective plenums 67, 68. Each of the plenums 67, 68 are primarily defined in the air blocks 33 and 34. However, when the die means 30 are assembled, the top area of each of the respective plenums 67, 68 are defined respectively by the lower surfaces 57 and 58 of the die halves 31, 32. These surfaces 57, 58 also form an upper portion of air passage 73 and 74, each of which respectively lead from their associated plenums 67 and 68 to the air slots 61 and 62. Accordingly, looking at the right hand side of FIG. 4, it will be appreciated that air can pass through the passageway 55 to the passageway 69 in air block 33, and from there to the plenum 67. "O"-rings, not shown, can be used at the interfaces of the respective die half and air block to seal passages 55, 56 with passages 69, 70, respectively. Pressurized air in the plenum 67 moves through the passageway 73 into the air slot 61.

In a like manner, air can be introduced to passageway 56 in the die half 32 and from there it can move into the air passageway 70 and into the lower portion of the plenum 68. From the plenum 68, pressurized air is directed through the air passage 74 into the air slot 62 of the air block 34.

Referring now briefly to the upper portion of FIG. 4, it will be appreciated that a controller 75 is operationally connected to valves V-1 and V-2, as shown, for controlling the introduction of heated, pressurized air to the passages 55 and 56, respectively, in order to pressurize those passages and the downstream air passages as previously described, with air. At the same time, the controller 75 is operationally interconnected to a hot melt control valve 76 for controlling the supply of coating material, such as wax or hot melt adhesive, to the passage 41 and to the internal coat hanger area 42 of the die means 30.

While any suitable form of controller 75 can be used, as is well known, one particular controller comprises a PC-10 pattern controller, manufactured by Nordson Corporation of Westlake, Ohio. The PC-10 pattern control 75 is operational to initiate and to stop the generation of air into passages 55 and 56, either simultaneously or independently, to initiate and to stop the wax or hot melt flowing through valve 76 so as to intermittently provide coating material to the passageway 41 independently and at pre-selected times with respect to the provision of pressurized heated air to the passages 55 and 56, and to control gun 16, all in a manner as will be described.

The air slots 61 and 62 are oriented on an angle with respect to the elongation of the extrusion slot 37. Accordingly, when coating material is extruded through the slot 37 and outwardly of the extrusion outlet 40, air moving through the air slots 61 and 62 is impinged on the material before that material engages or is deposited on an underlying substrate which is presented for coating, or for the application of the material as will be described.

Figure 6:
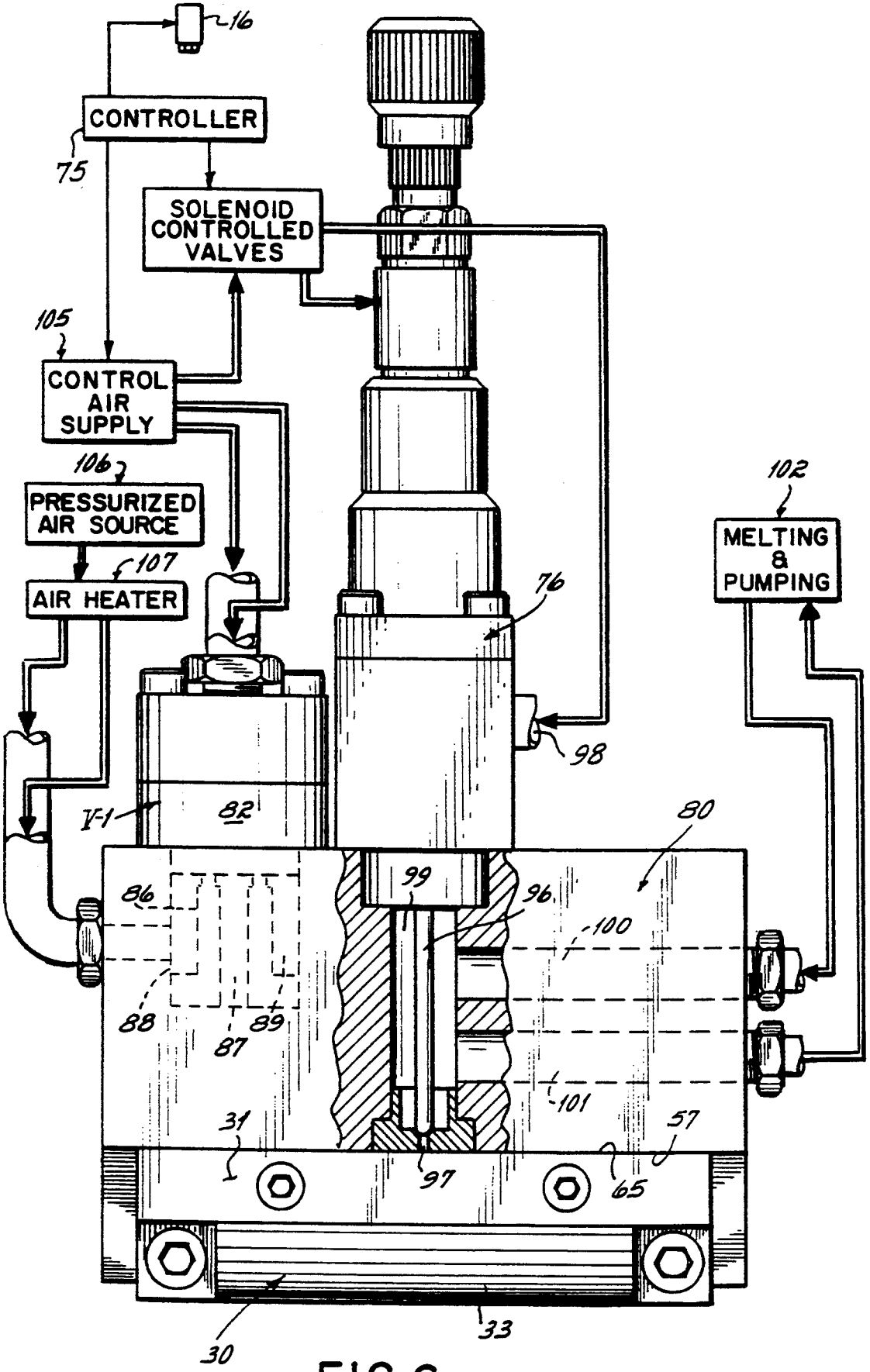
FIG. 6 is an elevational view in partial cross-section of the apparatus of FIG. 5, illustrating diagrammatically control and flow features of the apparatus for applying the coatings.

In the application of coating material to bottle necks as shown in FIGS. 1–3, the slot nozzle die means 30 is re-oriented 90 degrees from its position shown in FIGS. 4–6. In this position, the coating material is extruded not vertically, but horizontally, and is carried to the bottle neck 13 by the air flowing through slots 61 and 62.

Turning now to FIGS. 4–8 and 8*a*, there is shown more of the overall extrusion apparatus according to the invention. As shown in FIG. 5, the die means 30 is interconnected with air valves V-1, V-2 and wax or hot melt valve 76, each of which is interconnected with an extrusion body 80 which operationally interconnects the air and coating valves with the die means 30. For clarity, a portion of the air valve V-2 is shown in partial cross section in FIG. 5. Since the valves V-1 and V-2 are identical, only valve V-2 will be described. Such air valves are manufactured and distributed by Nordson Corporation through Nordson Engineering, Luneburg, Germany, under part no. 265701.

Valve V-2 comprises a valve body 82 defining a valve chamber 83 and a control chamber 84, the two chambers being separated by the diaphragm 85. An extension 86 having a bore 87 extending therethrough depends from the valve body 82 and extends into the bore 88 of extrusion body 80 to form an annular chamber 89 therewith. Chamber 89 is interconnected with an annular passageway 90 in the valve body 82, which interconnects with the chamber 83. An annular chamber 91 is also defined in the valve body 82 and interconnects with the chamber 83. When control air is directed into chamber 84, the diaphragm 85 is pushed downwardly to seal off the annular passage 90 from the annular passage 91. On the other hand, when pressure is decreased in the control chamber 84, the diaphragm moves upwardly to the position shown in FIG. 5. Air in the inlet annular chamber 89, which is heated and under pressure, communicates through the annular passages 90 through the chamber 83 and the annular passage 91, into the outlet bore 87. Outlet bore 87 is connected through a passageway 92 to the air passage 56 in the upper die half 32, as shown in detail in FIG. 4, where the air from there can move to the plenum 68 and into the air slot 62.

In like manner, the air valve V-1 is operable to selectively supply air to the air passage 93 in the extrusion body 80 and from there to the air passage 55 in the upper die half 31. Air moves through that passageway 55 into the plenum 67 and from there to the air slot 61.

The wax or hot melt valve 76 can be any suitable valve which cam be selectively controlled to initiate and to cut off the Flow of coating material, such as wax or hot melt adhesive, to the die means 30. One such suitable valve is balanced valve model no. EP51 produced by Nordson Corporation of Westlake, Ohio. Such valve minimizes significant change in pressures when the valve is switched between its opened and closed positions. The valve 76 has a stem 96 seated over a port 97. When control air is supplied to an inlet 98, the stem 96 is lifted to permit wax or hot melt adhesive in a chamber 99 to flow through the port 97 and into the passageway 41 of the upper die half 32. Coating material is introduced into the chamber 99 through hot melt inlet 100. A coating material outlet 101 is also interconnected with the chamber 99 to receive pressurized coating material when the stem 96 is seated on port 97.

Any suitable apparatus can be utilized for melting and pumping coating material to the valve 76. Such apparatus is shown diagrammatically at 102. While any suitable apparatus could be utilized, one particular form of apparatus which is suitable, for example, is the model HM640 applicator, manufactured by Nordson Corporation of Westlake, Ohio.

FIGS. 4 and 6 illustrate diagrammatically the various control inputs to the valves 76 and V-1. As shown in FIG. 4, the controller 75 is interconnected to a control air supply 105 for supplying control air to the valves V-1 and V-2. A pressurized air source 106 is interconnected to an air heater 107 which supplies process air to the valves V-1 and V-2 for transmission to the respective air slots 61, 62, as described above. When the respective valves V-1 and V-2 are opened, controller 75 is also interconnected to the control air supply for supplying control air through closed and opened solenoid control valves (shown in FIG. 6) to open and close the coating valve 76.

Referring now more particularly to FIG. 4 and the details of the die means 30 as shown in FIG. 7, it will be appreciated that the plenums 67 and 68 in the air blocks 33, 34 communicate with the lower surfaces 73A and 74A, respectively, of the air passages 73 and 74 as previously described, and air emanating from the upper portion of the plenums 07 and 68 moves through the passageways 73 and 74 and then downwardly through the respective air slots 61, 62.

Turning now to the so-called "coat hanger" portion 42 of the upper die half 32, and with reference to FIG. 7, it will be appreciated that "coat hanger" dies are known in general. For example, one coat hanger-type die for handling hot melt adhesive is disclosed in U.S. Pat. No. 4,687,137, expressly incorporated herein by reference. The difference in that structure is that it serves a plurality of die outlets, and not a continuous extrusion slot die as noted herein. While such a die could be used herein, nevertheless, the present die means 30 incorporates a "coat hanger" portion 42 having an arcuate slot or groove of increasingly shallow dimension 110 communicating with an incline surface 111. Surface 111 is inclined such that its lower portion, where it meets bottom surface 112, is closer to the plane of the face 39 than is the upper portion. It will also be appreciated that slot 110 is of decreasing depth as its distance from port 113 continues until it flows unbroken in surface 111. The arcuate slot 110 of decreasing depth is fed by the hot melt port 113, which is interconnected to the hot melt passage 41. In use, when wax or hot melt is supplied at pressure to the passage 41, it exudes through the port 113 into the arcuate slot 110 and from there flows over the surface 111 and spreads out throughout the relieved coat hanger shaped portion 42 of the die face 39 and the side of the shim 45 which is juxtaposed to the face 39 of the die half 32.

It will be appreciated that the slots 47 of shim 45 have upper ends which communicate with the lower portion of the coat hanger die area 42, just above the surface 112 thereof, so that wax, hot melt adhesive or other coating material can flow into the slots 47 and then downwardly to the extrusion outlet 40. In this manner, the coating material is spread throughout the coat hanger portion 42 and across each of the upper ends of the slots 47 of the shim 45 at significantly equal pressures, so that coating material can move through the extrusion slot 37 within the slots 47 of the shim 45 at relatively equal pressures.

As illustrated diagrammatically in FIG. 8, the material exudes through the slots 47 and then outwardly of the extrusion outlet 40 i.e. through a plurality of slot outlets or openings defined in the slot outlet between tips 49.

Considering the advantages of the segmented shim 45, it will be appreciated that the width of the slot 47 between projections 46 is preferably about twice the width of the shim thickness. The thickness of one shim 45 may be about 0.004" while the slot width, i.e. from one projection 46 across to the next projection 46, is about 0.008". In another shim 45, for example, the shim thickness is about 0.008" while the segmented slot width between juxtaposed projections is about 0.016".

Accordingly, the overall slot thickness between die faces 38, 39 can be doubled while the die still produces the same basis weight coating as a prior slot die where the die slot is not segmented, as in this invention. Thus in a prior slot die where a slot thickness of 0.002" was needed for a small basis weight coating, the present invention can obtain the same basis weight coating with a slot thickness of 0.004" or doubled. Thus, the slot die according to the invention could pass a potentially clogging particle of 0.003" while the prior continuous slot die would not (for the same basis weight coating to be produced).

While the ratio of the slot width to the shim thickness is preferably about 2 to 1, this ratio can be varied to produce varying coating thicknesses.

It will be appreciated that the width and thickness parameters of the shims 45, **45*a*** and their components can widely vary. The parameters may vary due to the basis weight of coating per square meter desired, the cohesiveness desired, the coating material viscosity or other factors.

In order to provide further description of one form of coat hanger portion 42, the surface 112 from face 39 back to surface 111 is about 0.020" wide. The tops of slots 47 are about 0.050" when the shim is operably disposed between faces 38, 39. The groove 110 at its deepest depth from face 39 is about 0.125" from face 39. The surface 111 at its top area is about 1/16" deep from face 111 and about 0.020" back from surface 39 at its bottom. The coat hanger width across face 39 is about 38 mm.

It will be appreciated that the coating material may be precisely delivered to the heads or nozzles by one or more material metering means such as metering gear pumps. A single pump could feed a manifold for all the heads or nozzles or a separate metering gear pump could be used for each head or nozzle, or for a group of nozzles of less than all nozzles. This precise delivery permits accuracy in the material delivery so that accurate basis weight coatings can be provided for varying substrate speeds, for example. Any suitable form of metering feeds can be utilized. For example, U.S. Pat. Nos. 4,983,109 and 4,891,249, expressly incorporated herein by reference, disclose metering means for hot melt adhesives.

Turning now to the use of the apparatus described above, for the application of wax or hot melt coatings to bottles, it will be appreciated that the apparatus is capable of impinging hot air from the slots 61 and 62 on each side of the coating material exuding from the vertically oriented extrusion outlet 40 (FIGS. 1–2) and that the controller 75 is operational to start and stop the application of air to the extruded coating material at different times and/or intervals compared to the starting and stopping of the delivery of wax or hot melt adhesive to the extrusion outlet 40.

For example, in one preferred method of operation, the flow of air through the slots 61, 62 is started a short time prior to the time when the valve 76 is operated to initiate the delivery of coating material into the slot 37 and out through the outlet 40. The air is continued for the coating deposition. At the end of the deposition period, the valve 76 is first operated to cease the extrusion of coating material through the outlet 40. After a short delay, the flow of air through the slot 61 and 62 is stopped. While the amount of delay in such an operation will vary, depending upon the properties of the wax or hot melt, such time period generally will preferably be on the order of micro seconds. One example would be, for example, 1700 micro seconds between the start up of the air and the start up of the extrusion of the hot melt material, and 2100 micro seconds between the stopping of the hot melt material and the stopping of the air. Continuation of the air flow much beyond this time might serve to pull off remaining wax or hot melt adhesive at the extrusion outlet and cause stringing of the deposited coating.

Moreover, it will also be appreciated that the invention contemplates the selective applications of air flow through either slot 61 or 62 individually or together during the deposition period.

For example, air flow can be initiated through slot 61 when there is no coating material being extruded through the slot 37 and no air flow has started through the air slot 62. Wax or hot melt flow starts and that is impinged on by air flowing through slot 61. Since the air flowing through slot 61 moves toward the extruded coating material, it will be appreciated that the coating material is blown off center from outlet 40 and does not string. Thereafter, and for most of the remainder of the coating operation, air flow is initiated and continued through the slot 62 and 61 together. At the end of the coating operation, the air flowing through slot 61 is terminated just before termination of the extrusion of the coating material. Then, once the coating material flow ceases, air flowing through slot 62 continues for a short time period thereafter. This operation can provide precise control over the line on the bottle neck where the sharp square edge coating begins, and ends.

Accordingly, the lag air is started first and stopped first and the lead air, that is, with respect to the bottle motion, is started after the extrusion of the coating material and stopped after the coating material extrusion has ceased. In this way, the air angling onto the coating material does not blow it in strings, as would be undesirable, yet the cut-off and cut-on edges of the coating material are maintained in sharp, square fashion on the bottle neck.

It will be appreciated that such precise control may not be necessary in many bottle coating applications, and that the air is started and stopped essentially with the extrusion on both sides of the coating material.

The invention is believed useful with a wide range of coating materials of different viscosities, as shown by the following:

WAX NO. 1:

Supplier: Dussek Campbell, Pty. Ltd. of Australia
Formula: DCA 9926
Viscosity: 16000 CPS at 120 degrees C.

It is important in these examples and other applications that the supply pressure and return pressure be maintained in a relationship, such that the differences of the two pressures are not more than 1 BAR.

As noted above, coatings are produced in varying weights. Such coatings can be varied from 0% open or impervious, to about 25% open or porous, if desired. Impervious, solid coatings or films are preferable for this application, of wax to wine bottle tops and necks, for example.

It will be appreciated that various sizes, spacings, pressures and selections of materials can be utilized. Thus, for example, the hot melt or wax might be started at 2 mm of bottle surface movement after air start up in both slots 61 and 62 simultaneously, and the air flow stopped at 5 mm of bottle surface movement beyond extrusion shut off, for bottle surface speeds of about 70 meters/minute.

After the coating is applied to top cork 14 and neck 13, the nature of the coating surface may be rough or porous. As shown in FIG. 3, heat is applied by additional permanently mounted or portable heat guns, or from the continued application of hot air from gun 16 and die 30 to render the coating less viscous so that it flows together and coalesces to form an integral, smooth finish seal.

Accordingly, the invention provides for non-contact coating operation with sharp, square-edged patterns and no stringing for a variety of bottle neck and top sealing applications, including production of an authentic, aesthetic, traditional neck seal without the drawbacks aforementioned or prior seals.

These and other modifications and advantages of the invention will become readily apparent to those of ordinary skill in the art without departing from the scope hereof, and the applicant intends to be bound only by the claims appended hereto.

We claim:

1. Apparatus operable for producing a coating onto the top and the neck of a bottle having an elongated axis extending from a bottle bottom through the neck and the top thereof, said apparatus comprising:

means for spinning a bottle about said axis;

a slot nozzle having an elongated slot outlet with two ends sand operable such that a coating material can be extruded through said outlet toward the neck of said bottle to coat the neck, said slot outlet being vertically oriented from one end to the other;

at least one air slot proximate said slot outlet and operable for impinging at least one air stream onto a coating material exuding horizontally from said slot outlet for carrying said extruded coating material to said bottle neck to coat said neck;

means for starting said one air stream prior to extrusion of coating material from said slot outlet; and means for applying coating material to a top of said bottle neck, coating material on said bottle neck and on said bottle top merging to form a seal over the top portion of the neck of said bottle.

2. Apparatus as in claim 1 including heating means for heating coating material applied to the bottle and for smoothing a surface of the coating material on a bottle.

3. Apparatus as in claim 1 further including means for stopping the air stream after extrusion of coating material through said slot outlet has ceased.

4. Apparatus as in claim 3 including at least two air slots, one proximate each side of said slot outlet for impinging air therefrom onto coating material exuding from said slot outlet.

5. Apparatus as in claim 4 further including means for delaying impinging air from one of said air slots until after coating material exudes from said slot outlet and for continuing flow of air from said one slot until after extrusion of said coating material has ceased.

6. Apparatus as in claim 5 further including means for initiating flow of air from the other air slot before coating material is extruded and for ceasing flow of air from said other air slot before extrusion of said coating material ceases.

7. Apparatus as in claim 1 including means in said slot nozzle extending at least to said slot outlet for dividing said slot outlet into a plurality of slot openings from which coating material exudes.

8. Apparatus as in claim 7 wherein said dividing means includes a shim having a plurality of juxtaposed elongated projections defining slots therebetween, said projections having tapered ends terminating at the outlet of said slot nozzle to define said openings.

9. Apparatus as in claim 8 wherein the distance between two of the juxtaposed elongated projections is about twice the thickness of said shim.

10. Apparatus as in claim 7 wherein said dividing means extends outwardly beyond said slot outlet.

11. Apparatus as in claim 10 wherein said dividing means includes a shim having a plurality of elongated juxtaposed projections defining slots therebetween, said projections having ends tapered to a point extending beyond the outlet of said slot nozzle.

12. Apparatus as in claim 1 wherein said means for applying coating material to a top of said bottle neck includes an applicator gun selectively operable to dispense a bead of coating onto a center of said top and selectively to dispense coating material on said top between said center and a peripheral edge thereof.

13. Apparatus operable for applying a coating to an elongated object rotating about a vertical axis, said apparatus comprising:

a slot nozzle having a vertically oriented elongated slot outlet operable such that coating material can be extruded in a generally horizontal direction through said outlet in a substantially vertical plane; and at least one elongated air slot means juxtaposed to and substantially parallel to said slot outlet for blowing air onto said extruded coating material and for carrying said coating material horizontally in a substantially vertically oriented film to a surface of said object to be coated.

14. Apparatus as in claim 13 further including means for applying coating material to an end of said object adjacent to said surface such that coating material on said object merges to form an integral coating over said object end and said surface.

15. Apparatus as in claim 14 further including means for spinning said object and said surface about said axis.

16. Apparatus as in claim 15 further including means for heating coating material applied to said object to produce a smooth coating finish surface on said material.

17. Apparatus as in claim 13 further including means for establishing relative motion between said surface and said slot outlet such that coating material extruding from said outlet coats said surface.

18. Apparatus as in claim 13 wherein said slot nozzle is disposed in a slot nozzle die comprising:

die halves comprising a die block and defining an extrusion slot therebetween, said die halves having tapered projections with parallel inward facing surfaces forming said extrusion slot and tapered outer walls respectively partially defining inward surfaces of two air channels disposed at an angle with respect to said extrusion slot;

two air blocks, each having a tapered surface juxtaposed in operative disposition near one of said tapered outer walls such that one of said air channels is formed therebetween;

an air plenum in each said air block;

an air passage in each air block interconnecting an upper portion of each said plenum with a respective air channel; and an air passage in each air block for feeding air to a lower portion of each said plenum.

19. Apparatus as in claim 18, including an air passage in each die half, each die half air passage operationally interconnected with one of said air passages in said air blocks for feeding air to said plenum therein.

20. Apparatus as in claim 18 wherein said air passage interconnecting an upper portion of a plenum with an air channel is defined by juxtaposed surfaces of a respective die half and air block.

21. Apparatus as in claim 18 wherein said respective air plenums are defined by juxtaposed surfaces of said respective die halves and air blocks.

22. Apparatus as in claim 13 including means in said slot nozzle for dividing said slot outlet into a plurality of slot openings through which coating material exudes.

23. Apparatus as in claim 22 wherein said dividing means includes a shim having a plurality of juxtaposed elongated projections defining slots therebetween, said projections having tapered ends terminating at the outlet of said slot nozzle and defining said openings.

24. Apparatus as in claim 23 wherein the distance between two of the juxtaposed elongated projections is about twice the thickness of said shim.

25. Apparatus as in claim 22 wherein said dividing means extends outwardly beyond said slot outlet.

26. Apparatus as in claim 25 wherein said dividing means includes a shim having a plurality of elongated juxtaposed projections defining slots therebetween, said projections having ends tapered to a point extending beyond the outlet of said slot nozzle.

27. Apparatus operable for applying a coating to the surface of an elongated object rotating about a vertical axis, said apparatus comprising:

a slot nozzle having an extrusion channel and an elongated, vertically oriented slot outlet disposed along said channel operable such hat coating material can be moved through said channel and extruded in a substantially vertical plane;

at least one air slot proximate said slot outlet and operable for impinging at least one air stream onto a coating material exuding from said slot outlet to produce a fibrous web of coating material for carrying said coating in a horizontal direction to said surface; and means in said channel extending at least to said slot outlet for dividing said slot outlet into a plurality of adjacent openings in said slot outlet from which coating material is extruded;

wherein said coating material extruded through each said opening merges into coating material extruded through adjacent openings to form a continuous coating web prior to impingement of air thereon.

28. Apparatus operable for applying a coating to an elongated object rotating about an axis, said object having an end and a cylindrical surface adjacent said end, said apparatus comprising:

a slot nozzle having an elongated slot outlet operable such that coating material can be dispensed through said outlet, an elongated air slot means juxtaposed to said elongated slot outlet for blowing air onto said coating material as it is dispensed form said slot outlet for carrying said coating material to said cylindrical surface of said object; and means for applying coating material to an end of said object such that coating material from said applying means, and on said end, merges with coating material from said elongated slot outlet, and on said cylindrical surface, to form a unitary coating on said end and said cylindrical surface.

* * * * *